United States Patent [19]

Tupper

[11] 4,109,329

[45] Aug. 29, 1978

[54] INVALID BED

[75] Inventor: Earl Silas Tupper, Panama City, Panama

[73] Assignee: TUP! (Panama) S.A., Panama City, Panama

[21] Appl. No.: 764,939

[22] Filed: Feb. 2, 1977

[30] Foreign Application Priority Data

Feb. 10, 1976 [GB] United Kingdom ..... 5197/76

[51] Int. Cl.[2] ..... A61G 7/10

[52] U.S. Cl. ..... 5/61; 5/81 B; 5/84

[58] Field of Search ..... 5/61, 81, 84, 85

[56] References Cited

U.S. PATENT DOCUMENTS

| | | | |
|---|---|---|---|
| 1,698,754 | 1/1929 | Gadbois | 5/61 |
| 3,302,219 | 2/1967 | Harris | 5/61 |
| 3,401,410 | 9/1968 | Welborn et al. | 5/61 |
| 3,506,985 | 4/1970 | Lang | 5/61 |
| 3,924,281 | 12/1975 | Gibbs | 5/81 D |

*Primary Examiner*—Casmir A. Nunberg

*Attorney, Agent, or Firm*—Pollock, Vande Sande & Priddy

[57] ABSTRACT

A bed or like equipment includes a loop of flexible material wide enough to hold a person lying down and a drive for material around the loop to rotate or rock the person. Preferably the loop hangs below and within the space between two parallel rollers with one or more rollers beneath the loop so that an endless belt of the material can be used.

23 Claims, 19 Drawing Figures

INVALID BED

This invention relates to a form of bed, or of bed-like massage and transportion equipment, which can be used either in a hospital for permanent or occasional treatment of a patient, in a clinic by a physiotherapist or like medical auxiliary, or in the home or gymnasium for exercise and health treatment.

It is usually considered advisable that patients in hospital should take such exercise as is applicable both to their physical condition, for instance after recovering from an accident or an operation, and to their mental condition, for instance in any form of catatonic withdrawal or like symptom of serious mental illness. A purpose of this exercise is to ensure that muscles do not become wasted through disuse and that the patient does not develop bedsores due to constant pressure of the body upon a given area with impairment of circulation and subsequent ulceration.

Usually such exercise is undertaken either as a part of the nursing routine (i.e. moving the patients around during bed-making), or as part of physiotherapy treatment. However, both of these forms of attention are expensive and time-consuming, and the present invention provides a means whereby the patient can be subjected to exercise or bodily movement without constant attention from expensive trained staff.

Additionally, non-hospitalized patients may need vigorous bodily movement but be unable to provide it unaided, thus needing visits to clinics, or by nurses in their own home. More generally, some form of vigorous movement can be beneficial to a wide range of people suffering from no well defined illness but generally in poor physical condition.

Moreover, a hospitalized patient occasionally needs to be transferred from a bed to another area for treatment, and a hospital bed should in any case be capable of providing easy access for the nurse and desirable privacy, and occasionally restraint, for the patient.

The present invention sets out to provide equipment capable of imparting general relative movement to different parts of the body of a person and/or an overall movement of said body in relation to a support, in which a loop of flexible material, which is wider than the person is tall in order to accommodate the person in a lying position, is supported at two suspension axes and drivable to move the material around in the loop direction, whereby the person is obliged to move as the material moves in the loop direction.

The loop of material may be part of an endless belt or part of a longer length of material which is wound up at one end thereof and unwound at the other.

The suspension axes may be defined along the surface of a rotary drum, e.g., with end flanges of greater diameter, whereby the loop has its margins lifted up. Such a drum may be constituted by a succession of wheels on a common shaft. Alternatively and preferably, however, the suspension axes are defined along the surfaces of two rotary cylindrical members which extend generally parallel to each other and generally horizontally, so as to allow the loop of material to lie beneath them. Such members can be provided with fixed or movable ridging members, so as to shape the loop, and are preferably spaced parallel horizontal rollers. This arrangement is of particular value in carrying out the invention and can be considered in two forms. In the first form, the material hangs as a loop outside the spaced rollers. This loop, which holds the person being treated, thus includes the rollers at its upper edges. In the second form, the material hangs as a loop, to hold the person being treated, inside the spaced parallel rollers.

For convenience in use, it is preferred in this embodiment that the rotary cylindrical members be adjustable in height to raise and lower the loop. It is also valuable, as described in more detail below, if one of the rotary cylindrical members is adjustable in height relative to the other. Horizontal spacing between the members, and the angle between their rotation axes, can also be adjustable. One or more additional rotary cylindrical members over which the material passes can also be incorporated.

It will be also found convenient if the rotary drum, or rotary cylindrical members, is or are mounted on a movable frame supporting a drive means for the said rotary drum or members. Usually the frame is mounted on wheels and is of a size and configuration such that it can be pushed to overlie a hospital bed with the loop parallel to the longitudinal direction thereof.

In a particularly preferred embodiment, the invention provides a hospital or like bed as described above wherein a head end support and a foot end support are separated by and support for rotation at least three spaced parallel horizontal rollers, and wherein two of said rollers are located at the same upper level to define the sides of said bed while the third, or additional, lower rollers are located below the said upper level so that the material can pass around all rollers and hang as a loop inside said two upper rollers.

There may for example be four such rollers located with their centers in a generally rectangular arrangement and thereby defining a top flight (comprising the loop), a bottom flight and two side flights to the material. As a further improvement, a fifth such roller can be located inside one side flight, spaced above one of the lower rollers, with a sixth such roller mounted for transverse movement into and through the space thereby defined so as to alter the shape of the loop hanging inside the two upper rollers.

Within the space defined by the rollers in a position which does not contact the loop of material, there may be located a waterproof (e.g., stainless steel) liner capable of draining to a drain port, an associated container for liquid at one end of the bed. Also within said space there may be provided a mattress frame, preferably readily removable at one or both end supports, and preferably movable between a lower position beneath the loop and an uppermost position between the two upper rollers.

A dust shield may be provided beneath the bottom flight of material. Each end support can be provided with adjustable legs.

The end supports also provide a convenient location for drive means (e.g., an electric motor), a blower for hot or cold air and an ultraviolet lamp acting on the loop.

A head end housing and a foot end housing can be provided to cover the respective supports. The foot end housing can include nurse-operable controls and the head-end housing can support the usual ancillary equipment and/or patient-operable controls.

The invention will be further described with reference to the accompanying drawings, in which.

Figure 3A:
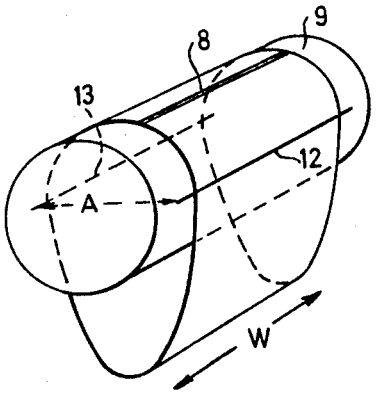
Figure 3B:
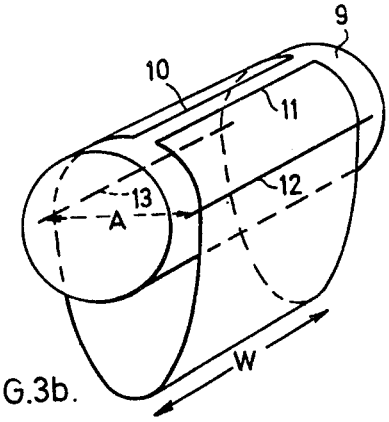
Figure 4A:
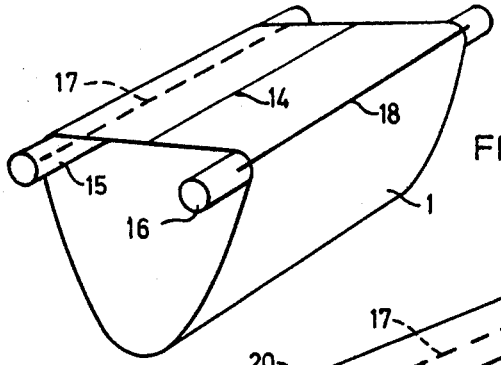
Figure 4B:
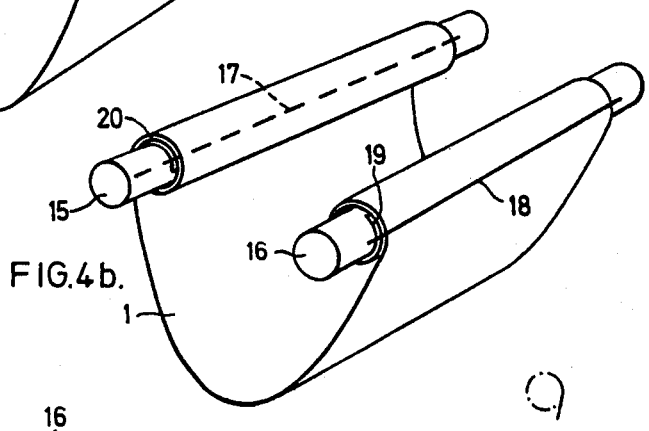
Figure 5A:
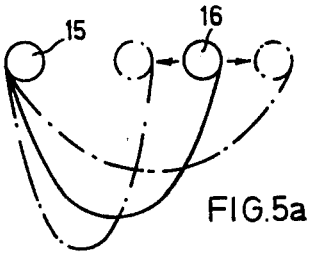
Figure 5B:
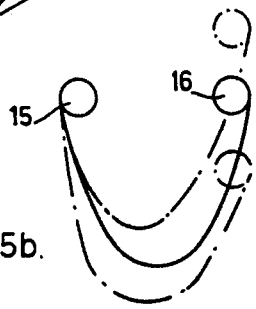

FIG. 3*a* shows a continuous belt of material over a drum to leave a loop beneath, while FIG. 3*b* shows a length of material connected at both ends to the surface of a drum;

FIG. 4*a* shows a continuous belt of material over two rollers with a loop beneath, while FIG. 4*b* shows a length of material wound at each end over rollers;

FIGS. 5*a* and 5*b* show the effect of roller displacement in the embodiment of FIGS. 4*a* and 4*b;*

Figure 6A:
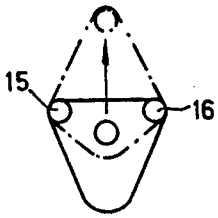
Figure 7A:
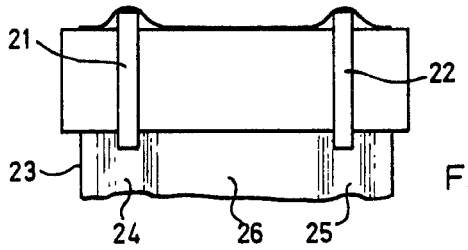
Figure 7B:
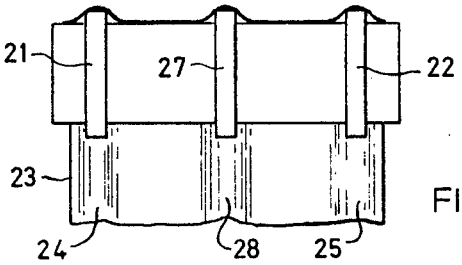
Figure 9:
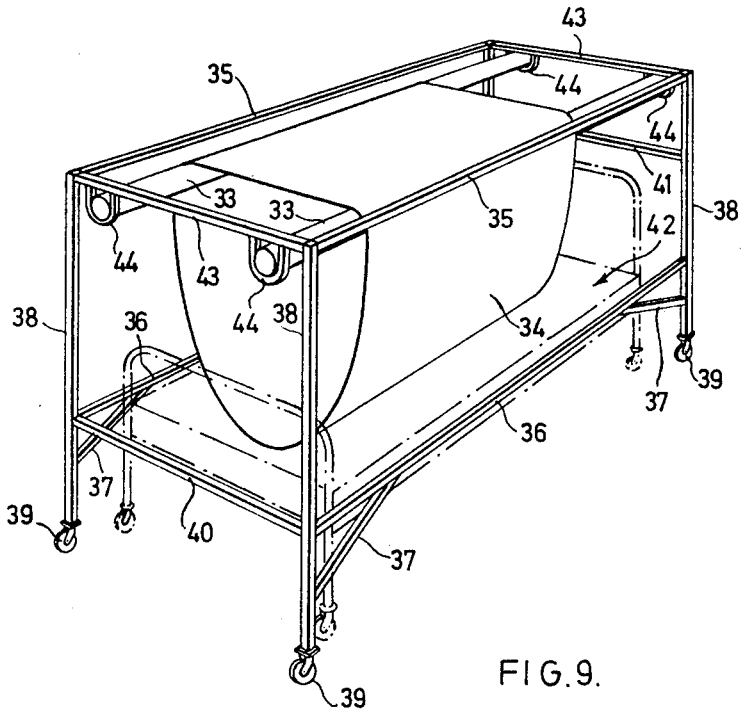
Figure 10:
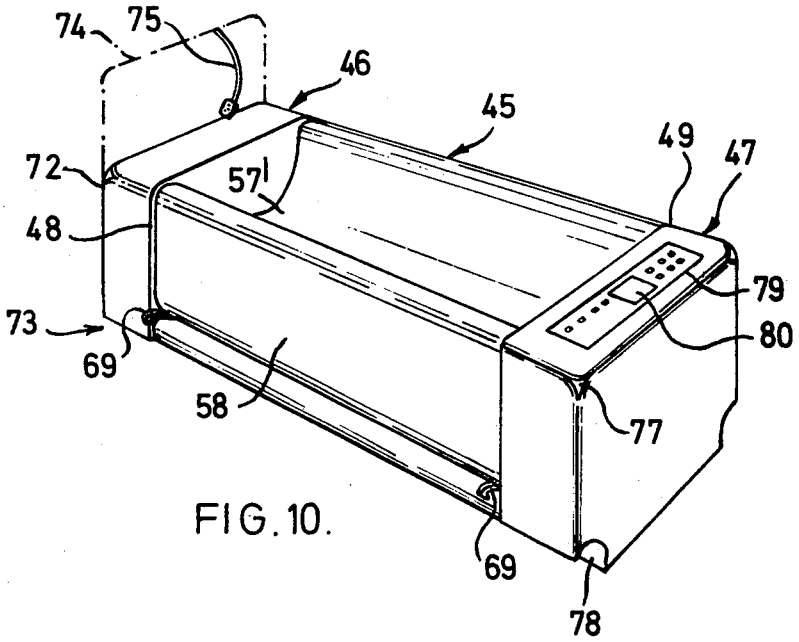
Figure 11:
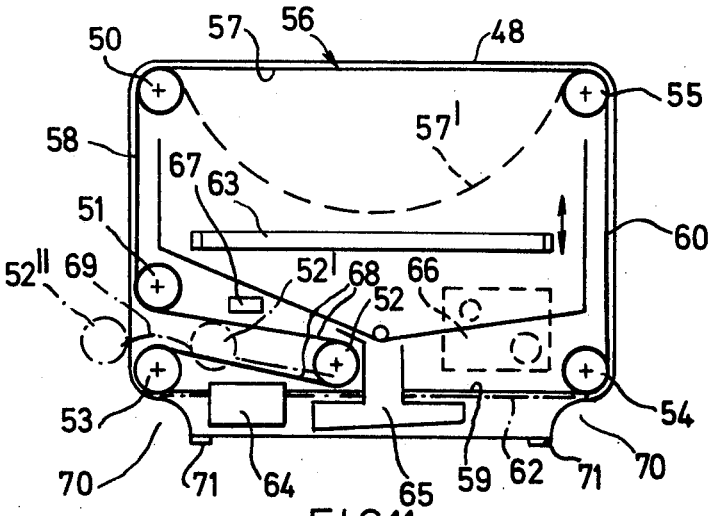

FIGS. 6*a,* 6*b* and 6*c* show, by way of example only, various additional rollers which can be used;

FIGS. 7*a* and 7*b* shows a profiled drum;

FIGS, 8*a,* 8*b* and 8*c* show variously profiled rollers;

FIG. 9 shows diagrammatically a roller-supporting frame in relation to a hospital bed;

FIG. 10 shows diagrammatically and in perspective form a further embodiment of the device; and FIG. 11 shows a diagrammatic view of one end of FIG. 10 with the protective housing removed.

Figure 1:
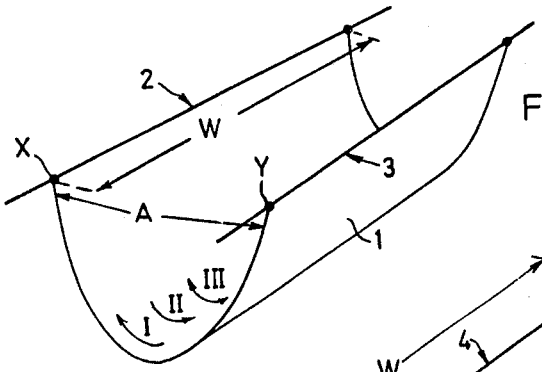
FIG. 1 shows diagrammatically and in perspective a loop of fabric suspended from two parallel suspension axes but otherwise unloaded.

In FIG. 1 a loop of flexible material 1 of width W and aperture A is held between two parallel straight suspension axes 2 and 3. Its cross-section is the catenary curve connecting X and Y. According to the invention it is capable of movement in the loop direction either only to the left (Arrow I) or only to the right (Arrow II) or as desired in either direction (Arrows III).

Figure 2:
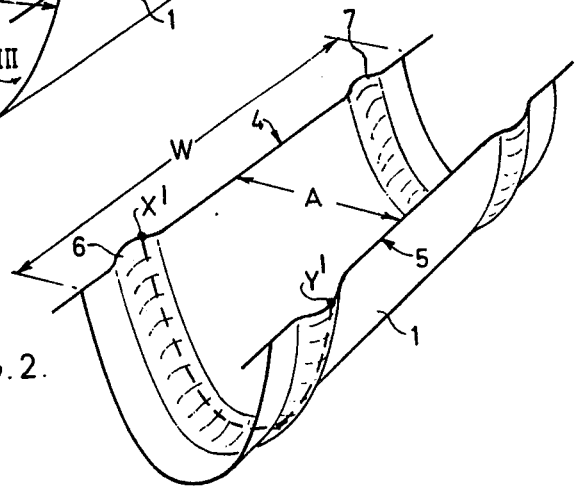
FIG. 2 shows a variant of FIG. 1.

The suspension axes are usually generally parallel or divergent only at a small angle, e.g., up to 15° -20°. If the loop is defined over suspension axes 4 and 5 as shown in FIG. 2, the aperture A will vary across the width of the loop, causing ridges 6 and 7 in the material, which is often desirable.

If a uniform cylinder of length W is placed inside the loop of FIG. 1 it will, depending on the weight and diameter of the cylinder and the flexibility and resilience of the material 1, pull the sides of the loop into a tangential relationship with the surface of the cylinder. If such a cylinder is shorter than length W, or if it is non-rigid or of non-uniform weight distribution, the shape of the loop will be somewhat complex, especially if unsymmetrically loaded. If the body in the loop is not a cylinder, there will be further variations in the shape of the loop as the loop moves in the loop direction. Finally, suspension axes as shown in FIG. 2 will give yet further variation in the shape of loop. The actual configuration of the loop when loaded with a patient is thus very complicated.

The loop of material can be part of an endless belt or part of a longer length of the material which is wound up at one end and unwound at the other as the material progresses in the loop direction. The suspension axes can both be provided on the surface of a single drum or like rotary member (or of a succession of such drums on aligned axes) or can be provided one on each of two generally similar rotary cylindrical members or succession of such, each with its respective aligned axes.

Thus, in FIG. 3*a* a loop of material 1 has its free ends connected as an endless belt at 8 over rotary drum 9. FIG. 3*b* shows a similar arrangement where the free ends of the loop are fixed to the drum at 10 and 11, and other arrangements, e.g., where the free ends of a loop progressively hang down from the drum as it rotates (inside or outside of the loop), or are collected on auxiliary rollers, can also be envisaged. In each case the suspension axis is shown as 12 and 13.

The cylindrical drum surface could be ridged circumferentially at intervals or replaced by a succession of wheels on a common shaft to give a ridged loop, e.g., as shown in FIG. 2.

In FIGS. 4*a* and 4*b* two parallel rollers carry the loop.

In FIG. 4*a* a loop of material 1 has its free ends connected at 14 to give an endless belt and is passed over parallel straight cylindrical rollers 15 and 16. The suspension axes for the loop are as shown at 17 and 18.

In FIG. 4*b* a length of material attached at one end to one roller, e.g., 16, is unwound therefrom, and attached and wound up at 20 on the other roller 15. The suspension axes are as before.

FIGS. 5*a* and 5*b* show the respective effects of altering the roller spacing and the relative heights of the rollers.

The embodiments shown in FIGS. 4*a,* 4*b,* 5*a* and 5*b* can be modified by additional rollers. FIGS. 6*a,* 6*b* and 6*c* show, by way of example only, multi-roller expedients that can be used.

The drum and rollers in FIGS. 3 to 6 are all shown as having plain surfaces. However, it is readily possible to provide a stepped surface.

Thus in FIG. 7*a* end flanges 21 and 22 give a loop 23 with the margins lifted up at 24 and 25 whereby a patient is safely held in the central portion 26 of the loop. FIG. 7*b* shows the flanges 21 and 22 plus a central shoulder 27 giving a ridge 28 in the loop for massage purposes. These flanges and shoulders can be integral or separate, removable, idle or fixed members optionally adjustable in position along the drum and faced with rubber or like friction-assisting material; indeed the "drum" could consist of suitably spaced wheels along a shaft.

Figure 8A:
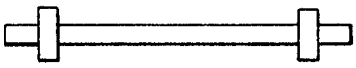

Similarly, the roller profiles as shown in FIGS. 8*a,* 8*b* and 8*c* all have the effect of ridging the loop and thus providing security and massage for the patient.

Figure 8B:
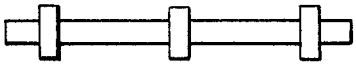
Figure 8C:
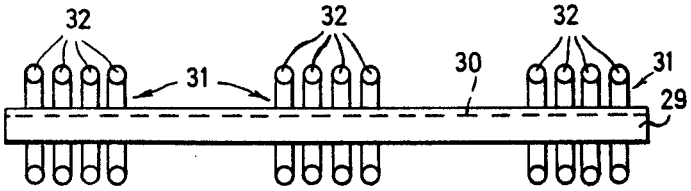

FIG. 8*c* shows how 12 rubber-tired wheels can be mounted on, and adjusted in position, along a rotary shaft.

Shaft 29 with longitudinal keying slot 30 (alternatively a square-section shaft could be used) supports twelve wheels 31 with rubber tires 32. As shown, this would provide uplift of the loop edges and a massage ridge along the centre of the loop. If however the wheels 31 were arranged six at one end and six at the other a shorter "pocket" would be provided in the loop and no central ridge would be present. If, again, the wheels were uniformly spaced a more or less unridged loop, or one in which the ridges were individually only small, would result. In each case, however, the same surface, i.e., the upper half of the tires 32, is presented for traction against the material.

Smooth rollers (as at 15 or 16) can be combined with a ridged roller as in FIGS. 6*a,* 6*b* or 6*c,* and still achieve the ridging of the loop as described with reference to FIGS. 7 and 8. In fact this movable roller could be replaced by smooth spaced guides which give a ridging effect when they are pressed against the material.

While the drums or rollers can be built in situ into a treatment room, it is much preferred to mount them on a separate and movable frame. Most preferably the frame is of a size as to surround a hospital bed, from which a patient can be lifted in the loop of material. Clearly the exact nature of the frame can be chosen for pleasing appearance, safety and ease of cleaning, but FIG. 9 shows in diagrammatic form a typical frame in relation to a hospital bed, with details of drive and control mechanisms not shown.

The device shown possesses rollers 33 and loop of material 34 in the form of an endless belt. These are supported on a frame consisting of upper side pieces 35 and lower side pieces 36 braced at 37 to uprights 38. Lower end pieces 40 and 41 also interconnect the uprights, end piece 41 being high enough off the ground to push the frame over a hospital bed generally indicated at 42. Finally upper end pieces 43 carry suitable bearings 44 for rollers 33.

The embodiment shown in FIG. 9 can be modified by optional features.

For example, creep toward one end of the rollers 33 can be counteracted by forming each end of rollers 33 with a helically ridged configuration of suitable 'hand' to resist such movement, or by splaying apart the rollers, i.e., by keeping them horizontal but not parallel. Alternatively, one or more inflatable toroidal members can take up the slack in relatively unstressed regions and thus avoid creep.

To improve traction with the belt, longitudinal or circumferential strips of rubber can be inset in or adhered to rollers 33.

For convenience in packing, and for moving from room to room, the frame can be foldable into a substantially flat configuration. A suitable electric motor and associated drive (not shown in FIG. 9) can either be mounted on the top of the frame, e.g., by bolting to the upper end piece 43, or an internal electric motor can be mounted within the end of one of the rollers 33.

The device as shown will usually be capable of (i) movement of material in the loop direction; (ii) raising and lowering of the loop; (iii) opening and shutting the loop, i.e., to alter aperture A; (iv) tilting the loop so that one edge is lower than the other; and (v) moving the whole equipment from place to place.

(i) Movement of Material in the Loop Direction

This should cover all possibilities, from rotating a patient rapidly for massage purposes to merely causing him to change his position occasionally to compensate for slow loop movement. It can be effected in the embodiment shown in FIGS. 3*a* and 3*b* by rotating the drum; in that of FIG. 4*a* by driving one or both rollers; and in that of FIG. 4*b* by driving both rollers simultaneously in the same direction: it would not be sufficient to drive one roller only since the weight in the loop would pull the loop downwards. It is preferably but not essential to drive the drum or rollers which define the suspension axes.

The drive for this movement is preferably an electric motor with a rheostat control to provide wide variability of speeds. An electric motor fixed on the upper part of an upright 38 in FIG. 9 and provided with a belt and pulley drive to one end of a roller 33 is envisaged, this assuring that the moving parts are well out of reach. However, pneumatic or hydraulic motors or even mechanical turning could be envisaged.

(ii) Raising and Lowering the Loop

Since it is often desired to lift a patient from, or replace him on, a bed as shown in FIG. 9, some way of moving the loop upwards in relation to the bed should be provided. Three modes of providing this are envisaged: (a) raising and lowering the whole frame, (b) raising and lowering a subframe either carrying the drum or, rollers, or in a possible embodiment, carrying a flat bed-type support (i.e., in place of a hospital bed), and (c) raising or lowering the loop itself.

Figure 6B:
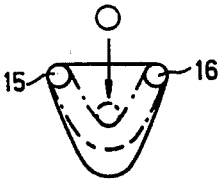
Figure 6C:
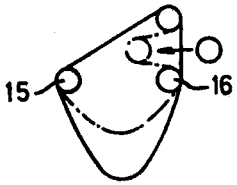

As to (a), the base of each upright can be in the form of a screw jack, which may be interconnectable so as to raise and lower each upright by the same amount. Alternatively, a hydraulic, pneumatic or mechanical jack can be used. As to (b), it is possible to modify FIG. 9 so that the rollers are on a separate frame which can be raised in relation to the main frame; it is also possible to make a permanent unit with the bed as an incorporated feature and arrange for the bed to be raisable and lowerable. As to (c), FIGS. 5 and 6 show various modes of raising and lowering the loop, and FIG. 4*b* shows that the loop can be raised by immobilizing one roller and winding up on the other until the desired position is reached.

(iii) Opening and Shutting the Loop

Since patients vary in size and the treatment to be given also varies, some way of altering the aperture of the loop, and thus the effective tangential angle of the loop where it contacts the body, should be provided. FIGS. 5 and 6 show possibilities of doing this, while FIG. 4*b* shows that unwinding one roller while displacing it to one side gives a different aperture and tangential angle without raising and lowering the loop. Hydraulic, pneumatic or mechanical drives are preferred to electric for this occasional adjustment.

(iv) Tilting the Loop

For some conditions, the feet should be raised higher than the head; for bathing or washing the patient the head should be higher than the feet. The necessary tilting action can be achieved by tilting the frame, by similarly tilting a sub-frame carrying the drum or rollers, or by splaying the rollers apart at one end thus raising the loop at that end only. Again, suitable mechanisms can readily be envisaged.

If the device is tilted, there will be a tendency for the loop to "track" towards the lower position; this tendency can be overcome to some extent by a frictional drum or roller surface, to a greater extent by clamping clips or co-operating rollers, and is not present in for example the device of FIG. 4*b*.

The various modes of movement (i) – (iv) are or can be interrelated, i.e., raising the loop can alter the tangential angle, and running the loop in the loop direction can shorten and raise it.

(v) Moving the Whole Device

FIG. 9 shows a frame on castors so that it can be moved from bed to bed, with or without conveyance of a patient. Also, the frame can be moved by this expedient to a washing area or other treatment zone. A permanent installation with a frame on rails running either end (or side) of a succession of beds is also possible, since the frame of FIG. 9 can readily be modified so as to be movable all the way over and past a bed, either longitudinally of transversely. Usually a motorized frame is unnecessary, and it is sufficient to push the frame around.

The material of the loop can be widely variable depending on intended use, and examples are wire, polymer net or synthetic fiber fabric. Obviously replacement of one material by another is very simple. Elastic or inelastic materials can be used.

The embodiment shown in FIGS. 10 and 11 consists generally of a bed portion 45, a head end housing 46 and a foot end housing 47.

The bed portion 45 comprises two end boards 48 and 49 separated by, and supporting for rotation, six parallel rollers 50, 51, 52, 53, 54 and 55. Around the rollers is located an endless fabric belt 56 wide enough to extend from one end board to the other and exhibiting a top flight 57, side flight 58, bottom flight 59 and side flight 60, (see FIG. 11). Also extending from one end board to the other is a stainless steel liner 61, a dust shield 62 beneath bottom belt flight 59, and a mattress support frame 63 insertable through slots in one or both end boards and supported on a frame, (not shown) for movement up or down. At one or the other end board there are also located a drive mechanism 64 such as an electric motor, a waste container 65 for draining the liner 61, an air blower unit 66 for hot or cold air as described, and ultraviolet lamp 67.

Rollers 50, 51, 52, 54 and 55 are idly mounted. Roller 53 is driven by drive mechanism 64 through a conventional belt or gear drive, not shown. Roller 52 is mounted on a guide 69 so as to be capable of movement from its extreme inner position (as shown) through intermediate positions such as 52' to an extreme outer position 52". Clearly when this roller is at position 52' the inner belt flights 68 are shorter than those shown in the drawing, whereby the top flight 57 drops in a loop to position 57', as also shown in FIG. 10.

The drive 64, container 65, blower 66 or lamp 67 can be associated with either end board. Each board is however provided with toe-spaces 70 and adjustable legs diagrammatically shown at 71 so that one end or other of the whole bed can be raised for treating the patient, or both ends raised for cleaning beneath the bed. Preferably at least the upper edge of each end board is provided with removable padding.

The head end housing 46, which can be hinged to or clipped on the end board 48, is a metal pressing with rounded corners 72 and the spaces 73. It can be provided with a more or less conventional bed head 74, e.g., for supporting ancillary equipment such as a saline drip or a patient-operated bed control pigtail 75.

The foot end housing 47 will generally be rather deeper than the head end housing to house the various features described above, and possesses rounded corners 77 and toe spaces 78. In the embodiment shown, it also possesses a control panel 79 for nurse operation, supplementing and/or replacing and/or overriding the patient's control 75, and a location for patient record cards 80.

A bed of this nature operates, and can be used, as follows.

Firstly, to thread the belt 56, roller 52 is put into its extreme outer position 52", thus allowing a leading, disconnected, edge of belt 56 to be dropped behind roller position 52" and into the gap between driven roller 53 and dust shield 62. Depending on the material, it can be pushed or manipulated across this shield, under the idle roller 54, and drawn up by hand to interconnect with the trailing edge, e.g., by a zip fastener. In practice two rubber or hooked-polymer bands can be permanently located, one near each end board, to assist such threading, and it is also possible to provide a strong semi-permanent belt (e.g. of metal-reinforced polymer net) and attach to this as required a suitably surfaced belt to contact the patient.

Secondly, with the belt (or composite belt) threaded, the roller 52 at position 52' and the mattress frame 63 at its lowest position, or removed, the patient can be suspended in the loop 57' for the various oscillating or rotating movements previously described for a period of any desired length.

Thirdly, in a stationary or sleeping mode, the mattress frame can be raised partway or to the top level so as to support the patient with the belt stationary. If desired, another mattress can be slipped under the patient (e.g., by brief rotation of the belt) to give a more or less conventional arrangement for use with sheets and blankets.

Fourthly, the mattress frame can be removed, altogether, the belt disassembled until only the strong net base remains, and the roller 52 put into position 52' or 52". The patient is then suspended in a loop of net for washing or like treatment, liquid draining into liner 61 and container 65 for subsequently disposal. The blowers 66 and lamp 67 can be used to clean and dry the net prior to reassembling a soft cover upon it, as described above.

Finally, with the mattress frame at its top position and roller 52 in the position as shown in FIG. 11, rotation of the belt slides the patient towards a desired edge of the bed for transfer, e.g., to a similarly constituted stretcher or wheelchair or other surface. Clearly, it is generally desirable in such a case to use soft rubber-faced rollers at 50 and 55.

The advantages of the embodiment shown in FIGS. 10 and 11 can thus be described as follows:

(a) it is of a generally "enclosed" and safe construction, and has all its drive mechanism enclosed and the "pocket" of belt fabric formed, the inner belt flight 68 with its parallel walls moving in opposite directions so as to resist entrapment of any article;

(b) it can readily resemble a conventional bed in terms of access and the possibility of use in (for example) an oxygen tent, but when used with a loop 57', free or supported on the matress 63, it also gives (i) restraint against a child or mentally disturbed patient getting out and (ii) privacy for bathing or medical treatment;

(c) it enables a nurse not only to turn and bathe a patient single-handed, but also to transfer a patient to a flat surface at either side of the bed.

Control 75 is operable by the patient and control panel 79 is operable by the nurse. Control 76 is a hand-held switch-box on a resilient "pigtail" mounting, typically giving a succession of switches progressively controlling start, rocking movements of progressively greater amplitude, continuous movement in either direction, and stopping. Possibly the patient could also control the raising and lowering of the loop 57' and/or mattress 63, and even washing sprays or drying air.

The nurse's control on foot-end housing 47 can also control (or override) all of the above and additionally give a preset program with a timed sequence of operations to be initiated either by the nurse or patient. A "centering" control for the belt and an emergency stop control are also envisaged.

The devices according to the various drawings have two main areas of utility and advantage, namely:

(a) compatibility with, and assisting the execution of, general nursing techniques, whatever the condition of the patient; and (b) medical treatment of the patient.

In nursing, the heavy tasks all involve lifting and/or transporting the patient. In bed-making, a bedridden patient must be sat up, lifted and/or rolled on his side several times a day. Moving a patient from a bed to a wheelchair is also heavy work.

It is, however, extremely simple to put a patient into the loop as shown for example in FIGS. 3*a* or 4*a*. The patient, lying on a bed, can be rolled to one side and one free edge of the material placed behind the patient's back and extending along the bed. The patient can then be rolled back on to the material, through 180° and the other free edge attached to the first mentioned edge, e.g., by zip fastening. When raising the loop lifts the patient above the bed for rotation, gentle movement, or transfer to another location. Such transfer or treatment is carried out in the privacy afforded by the sides of the loop.

Alternatively, a more or less conventional bed can be made up with a central portion of the material beneath the patient as a single layer and the end portions folded over as two layers. Optionally these can all be tucked in at the side. It is simple, when desired, to attach one side to one roller as in FIG. 4*b* and the other side to the other roller. The design of FIG. 4*a* could also be lowered toward the patient enough to pass the end portions over the roller and unite their edges. It is even possible to bring rollers as at FIG. 4*b* down to the edges of the bed and untuck and unfold the bed clothes as they rise again for use.

Tilting the loop also allows the patient to be immersed in a bath while still securely held and with his face clear of the water; turning the patient from one side to another is also facilitated.

The medical treatment of the patient can be considered in three somewhat overlapping ways, (i) on the skin, (ii) on the tissues, and (iii) on the internal organs.

The effect on the skin would rely on the material used, the speed of movement and the aperture of the loop. For instance, if the loop were made of wire, or harsh plastic net of, say, 0.5 to 1.0 (13–25 mm) inch mesh, it would press into, and have a tonic effect on, the skin, especially if the body were rapidly rotated in a very close loop. Thus this mode of action could be used on skin conditions or possibly as an exercise device in a gymnasium, e.g., in combination with hot water sprays.

The effect on the tissues is mostly concerned with the prevention of bed-sores. By changing the patient's weight distribution, or by forcing him to move to counteract the movement of the loop, or by turning him over occasionally, dangerous build-up of pressure on the tissues, leading to cutting-off of blood and like tissue fluids and consequent formation or exacerbation of bed sores, can be avoided.

The effect on internal organs is more usually connected with occasional drastic movement, e.g., by occasional spells of physiotherapy. Turning the patient over and over can stimulate the internal organs and more especially the gastrointestinal tract tract to relieve gas pains.

It will be apparent therefore that the invention provides a machine having a belt-like material capable of supporting a person, so that the person can be rolled as the belt is raised on either side of the person and lowered on the corresponding side of the person, thus producing a massage action both on the surface of the body and internally due to the weight of the body and the manipulation of the body which results from the manipulation of the supporting fabric.

I claim:

1. Equipment capable of imparting general relative movement to different parts of the body of a person and overall movement of said body in relation to a support, comprising (a) a movable frame of a size and configuration sufficient to overlie a hospital bed;

(b) a horizontally mounted rotary drum journalled on said frame;

(c) an endless belt defining in part a loop of flexible material, passing over and hanging beneath said drum from two suspension axes defined in the curved surface of said drum;

(d) said loop being parallel to the longitudinal axis of and wider than the said person is tall in order to accommodate the said person in a lying position; and (e) drive means mounted on said frame and operatively connected to rotate said drum, whereby the material is moved around in the loop direction and the person is thereby obliged to move within the loop.

2. Equipment capable of imparting general relative movement to different parts of the body of a person and overall movement in relation to a support, comprising (a) a movable frame of a size and configuration sufficient to overlie a hospital bed;

(b) two rotary cylindrical members journalled on said frame to extend generally parallel to each other and generally horizontally, so as to define two suspension axes;

(c) an endless belt defining in part a loop of flexible material, hanging beneath said rotary cylindrical members from said suspension axes;

(d) said loop being parallel to the longitudinal axis of said bed and wider than the said person is tall in order to accommodate the said person in a lying position; and (e) drive means variable in speed and direction mounted on said frame and operatively connected to rotate at least one of said cylinders, whereby the material is moved around in the loop direction and the person is thereby obliged to move within the loop.

3. Equipment as claimed in claim 1, wherein in which said drum is provided with end flanges of greater diameter whereby the loop has its margins lifted up.

4. Equipment as claimed in claim 1, wherein in which said drum is constituted by a succession of wheels on a common shaft.

5. Equipment as claimed in claim 2 wherein said cylindrical members are parallel horizontal rollers.

6. Equipment as claimed in claim 4 further comprising ridging members, so as to shape the loop located on said rollers.

7. Equipment as claimed in claim 4, further compising adjustment means whereby said rollers are adjustable in height to raise and lower the loop.

8. Equipment as claimed in claim 4 further comprising adjustment means whereby one of said rollers is adjustable in height relative to the other.

9. Equipment as claimed in claim 4 further comprising adjustment means whereby the horizontal spacing between the said rollers is adjustable.

10. Equipment as claimed in claim 8, further comprising adjustment means whereby the angle between the rotation axes of the said rollers is adjustable.

11. Equipment capable of imparting general relative movement to different parts of the body of a person and overall movement of said body in relation to a support, comprising a loop of a flexible material, which is wider than the person is tall in order to accommodate the person in lying position; a head end support; a foot end support; at least three spaced parallel horizontal rollers supported by and extending between said supports, two of said rollers being located at the same upper level to define the sides of a bed and any further roller being located at a lower level below the said upper level so that the material can pass around all rollers and hang as said loop inside said two upper rollers which thereby constitute two suspension axes; and driving means to move said material around in the loop direction whereby the person is obliged to move as the material moves in the loop direction.

12. Equipment as claimed in claim 11 comprising four such rollers located with their centers in a generally rectangular arrangement, thereby defining a top flight comprising the said loop, a bottom flight and two side flights to the material.

13. Equipment as claimed in claim 11, further comprising a fifth such roller located inside one side flight, spaced above one of the lower rollers, and a sixth such roller mounted for transverse movement into and through said space thereby defined so as to alter the shape of the loop hanging inside the two upper rollers.

14. Equipment as claimed in claim 10, further comprising a waterproof liner located within the space defined by the rollers, but in a position which does not contact said loop of material.

15. Equipment as claimed in claim 10 further comprising a mattress frame located within the space defined by the rollers said frame being movable between a lower position beneath said loop and an uppermost position between said two upper rollers.

16. Equipment as claimed in claim 10, further comprising a dust shield located beneath the bottom flight of material.

17. Equipment as claimed in claim 10, further comprising adjustable legs located at each end support.

18. Equipment as claimed in claim 10, further comprising a head end housing and patient-operable controls supported thereby, and a foot-end housing and nurse-operable controls located thereat.

19. Equipment capable of imparting general relative movement to different parts of the body of a person and overall movement in relation to a support, comprising (a) a frame of a size and configuration sufficient to overlie a hospital bed;

(b) two parallel horizontal rollers journalled on said frame;

(c) an endless belt defining in part a loop of flexible material, carried over and with said loop hanging beneath said rollers, said loop being parallel to the longitudinal axis of said bed and wider than the said person is tall, in order to accommodate the said person in a lying position;

(d) said endless belt being formed by disconnectable end-to-end attachment of free edges of a strip of said material; and (e) drive means operatively connected to at least one of said rollers, whereby the material is moved around in the loop direction and the person is thereby obliged to move within the loop.

20. Equipment capable of imparting general relative movement to different parts of the body of a person and overall movement in relation to a support, comprising (a) a frame of a size and configuration sufficient to overlie a hospital bed;

(b) a first pair of parallel horizontal rollers journalled on said frame;

(c) a second pair of parallel horizontal rollers journalled on said frame beneath and parallel to said first pair of rollers;

(d) an endless belt defining in part a loop of flexible material carried over all said rollers and with said loop hanging beneath said rollers, said loop being parallel to the horizontal axis of said bed and wider than the said person is tall in order to accommodate the said person in a lying position;

(e) said endless belt being formed by disconnectable end-to-end attachment of free edges of a strip of said material; and (f) drive means operatively connected to at least one of said rollers of said upper pair, whereby the material is moved around in the loop direction and the person is thereby obliged to move within the loop.

21. Equipment capable of imparting general relative movement to different parts of the boy of a person and overall movement in relation to a support, comprising (a) a movable frame of a size and configuration sufficient to overlie a hospital bed, and itself comprising four support legs and screwjacks located in each such leg to permit raising, lowering and tilting of said frame;

(b) an endless belt defining in part a loop of flexible material, carried over and with said loop hanging beneath said rollers, said loop being parallel to the longitudinal axis of said bed and wider than the said person is tall in order to accommodate the said person in a lying position;

(c) said endless belt being formed by disconnectable end-to-end attachment of free edges of a strip of said material; and (d) drive means operatively connected to at least one of said rollers, whereby the material is moved around in the loop direction and the person is thereby obliged to move within the loop.

22. Equipment capable of imparting general relative movement to different parts of the body of a person and overall movement in relation to a support, comprising:

(a) a frame of a size and configuration sufficient to overlie a hospital bed;

(b) two parallel horizontal rollers journalled on said frame;

(c) an endless belt defining in part a loop of flexible material, carried over and with said loop hainging beneath said rollers, said loop being parallel to the longitudinal axis of said bed and wider than the said person is tall in order to accommodate the said person in a lying position;

(d) said endless belt being formed by disconnectable end-to-end attachment of free edges of a strip of said material;

(e) drive means operatively connected to at least one of said rollers, whereby the material is moved around in the loop direction and the person is thereby obliged to move within the loop; and (f) patient operable drive control means dependent from the frame and accessible from inside the loop.

23. Equipment as claimed in claim 21, further comprising overriding nurse-operable drive control means inaccesible by the patient inside the loop.

* * * * *